US007588204B2

(12) United States Patent
Douglas et al.

(10) Patent No.: US 7,588,204 B2
(45) Date of Patent: Sep. 15, 2009

(54) MOBILE 3-PART CRUSHER ASSEMBLY

(75) Inventors: Paul Douglas, Derbyshire (GB); Terence Bratton, Derbyshire (GB)

(73) Assignee: Extec Screens and Crushers Limited, Derbyshire (GB)

( * ) Notice: Subject to any disclaimer, the term of this patent is extended or adjusted under 35 U.S.C. 154(b) by 471 days.

(21) Appl. No.: 10/525,581

(22) PCT Filed: Jul. 3, 2003 (Under 37 CFR 1.47)

(86) PCT No.: PCT/GB03/02855

§ 371 (c)(1), (2), (4) Date: Jul. 31, 2006

(87) PCT Pub. No.: WO2004/018106

PCT Pub. Date: Mar. 4, 2004

(65) Prior Publication Data

US 2008/0302894 A1 Dec. 11, 2008

(30) Foreign Application Priority Data

Aug. 22, 2002 (GB) ..... 0219563.4

(51) Int. Cl.
*B02C 21/02* (2006.01)

(52) U.S. Cl. ..... 241/101.76

(58) Field of Classification Search .....
241/101.71–101.763, 285.1, 285.2, 285.3
See application file for complete search history.

(56) References Cited

U.S. PATENT DOCUMENTS

| | | | | |
|---|---|---|---|---|
| 3,563,477 | A * | 2/1971 | Schroeder et al. | 241/101.76 |
| 4,763,845 | A | 8/1988 | Guggenheimer et al. | |
| 5,460,332 | A * | 10/1995 | Frick | 241/101.74 |
| 5,647,545 | A | 7/1997 | Conner | |
| 5,878,967 | A * | 3/1999 | Conner | 241/79.1 |

FOREIGN PATENT DOCUMENTS

| | | |
|---|---|---|
| EP | 0327678 | 8/1989 |
| GB | 1246190 | 9/1971 |

* cited by examiner

*Primary Examiner*—Mark Rosenbaum
(74) *Attorney, Agent, or Firm*—Kirton & McConkie; Evan R. Witt

(57) ABSTRACT

A mobile 3-part crusher assembly is disclosed having a feeder section, a crusher section and a discharge section which are detachably connectable together to work in a crushing mode, and can be separated from each other for individual handling and transport in a transport mode of the assembly. The crusher section is pivotally connected to the discharge section, and the feeder section and the discharge section are maneuverable independently of each other. There is also a coupling between a forward pivot on a forward conveyor portion of the discharge section on a pivot support provided on either the feeder or crusher section. The forward conveyor portion has two articulated sections, and with the foremost section being capable of underlying the discharge outlet for crushed material from the jaws of the crusher section.

8 Claims, 8 Drawing Sheets

FEEDER SECTION (1) IN TRANSPORT POSITION

CRUSHER (2) SECTION IN TRANSPORT POSITION

DISCHARGE (3) SECTION IN TRANSPORT POSITION

MOBILE 3-PART CRUSHER ASSEMBLY

This invention relates to a mobile 3-part crusher assembly, of which a first part is a feeder unit or section, a second part is a crusher unit or section, and a third part is a discharge unit or section.

In use, bulk raw material to be crushed is supplied to the feeder section and which feeds the raw material to the crusher section, which breaks up the raw material into crushed material, and which then delivers the crushed material to the discharge section and which discharges the crushed material to a stockpile.

One or both of the crusher section and the discharge section may include a screening device to separate unwanted material, e.g. too large or too small fragments from the crushed material, so that the material discharged to the stockpile can be in a predetermined size range.

It is known to provide small/medium size crusher plant assemblies in which the three separate components (feeder, crusher and discharge unit) are incorporated in a single vehicle, i.e. they are mounted on a common chassis of the vehicle (directly or indirectly), and such a vehicle being self-propelled so as to be manoeuvred on site, e.g. a quarry site, so as to receive a bulk supply of raw material and to discharge crushed raw material to a required stockpile.

A small/medium self propelled crusher therefore can be easily manoeuvred on site, but when it is required to move the crusher to another site, it is usually necessary to load the crusher onto a low-loader and for it to be transported along the public highway to a new site. Evidently, even a small/medium size self-propelled crushing plant is of substantial size, i.e. length wise, transversely and by height, and there are practical limits to the size of plant which can be transported along the public highway, assuming that the plant cannot readily be broken down into smaller separate sections, or be adjusted to take up a transport mode in which the overall "envelope" of the plant is substantially reduced in size.

The present invention, in one aspect, has been developed primarily in connection with a crusher assembly of substantial size, and which is too large to be transported along the public highway without first being broken down into two or more separate sections which can be individually loaded, transported and unloaded by more than one transport vehicle.

According to one aspect of the invention, there is provided a mobile 3-part crusher assembly of which a first part is a feeder section for receiving a bulk supply of raw material, a second part is a crusher section to receive raw material from the feeder section, and a third part is a discharge section to receive crushed material from the crusher section and to discharge the crushed material to a required stockpile:

in which the first, second and third parts of the crusher assembly are detachably connectable to work together in a crushing mode, and to be separated from each other for individual handling and transport in a transport mode of the assembly.

Any suitable detachable couplings may be provided to enable the crusher section to be coupled with, and uncoupled from, the feeder section, and to be coupled with, and uncoupled from, the discharge section.

The invention is also, in a second aspect, concerned with a 3-part crusher assembly which has improved manoeuverability on site when it is required to work in a crushing mode.

According to a second aspect of the invention, there is provided a mobile 3-part crusher assembly of which a first part is a feeder section for receiving a bulk supply of raw material, a second part is a crusher section to receive raw material from the feeder section, and a third part is a discharge section to receive crushed material from the crusher section and to discharge the crushed material to a required stockpile:

in which the crusher section is pivotally connected to the discharge section, and the feeder section and the discharge section are manoeuvrable independently of each other, so as to facilitate overall manoeuverability of the assembly on site.

Preferably, the crusher section has two separate articulated connections to the discharge section, defining pivot axes which extend approximately perpendicular to each other when the assembly is standing on level, horizontal ground.

A first articulation may therefore allow transverse relative steering movement between the discharge section and the remainder of the assembly (the crusher section and the feeder section) and a second articulation (defining a transverse axis extending generally parallel to the ground and perpendicular to the direction of forward travel), allows relative upward or downward pivoting between the discharge section and the remainder of the assembly, so as to follow undulations in the surface of the ground over which the assembly is travelling.

Preferably, each of the feeder section and the discharge section is supported by a respective pair of endless tracks, and which are independently operable, preferably being provided with their own power sources.

Conveniently, the crusher unit is a jaw-type crusher device and which is detachably coupled with the feeder section via a rigid coupling which allows the crusher section to be mounted in a cantilever manner on the feeder section to be moveable therewith as a unit, for the purposes of:

(1) loading and unloading the crusher section with reference to a loading platform of a transport vehicle; and (2) coupling and uncoupling the unit with the discharge section via a detachable coupling between the crusher section and the discharge section.

The crusher section or the discharge section may include one or more screening portions to separate crushed material into different size range(s).

A preferred embodiment of mobile 3-part crusher assembly according to the invention will now be described in detail, by way of example only, with reference to the accompanying drawings, in which:

FIGS. 1(*a*) and 1(*b*) are side and plan views of a mobile 3-part crusher assembly according to the invention, of which a first part is a feeder section, a second part is a crusher section, and a third part is a discharge section, all coupled together to work in a crushing mode;

Figure 6:
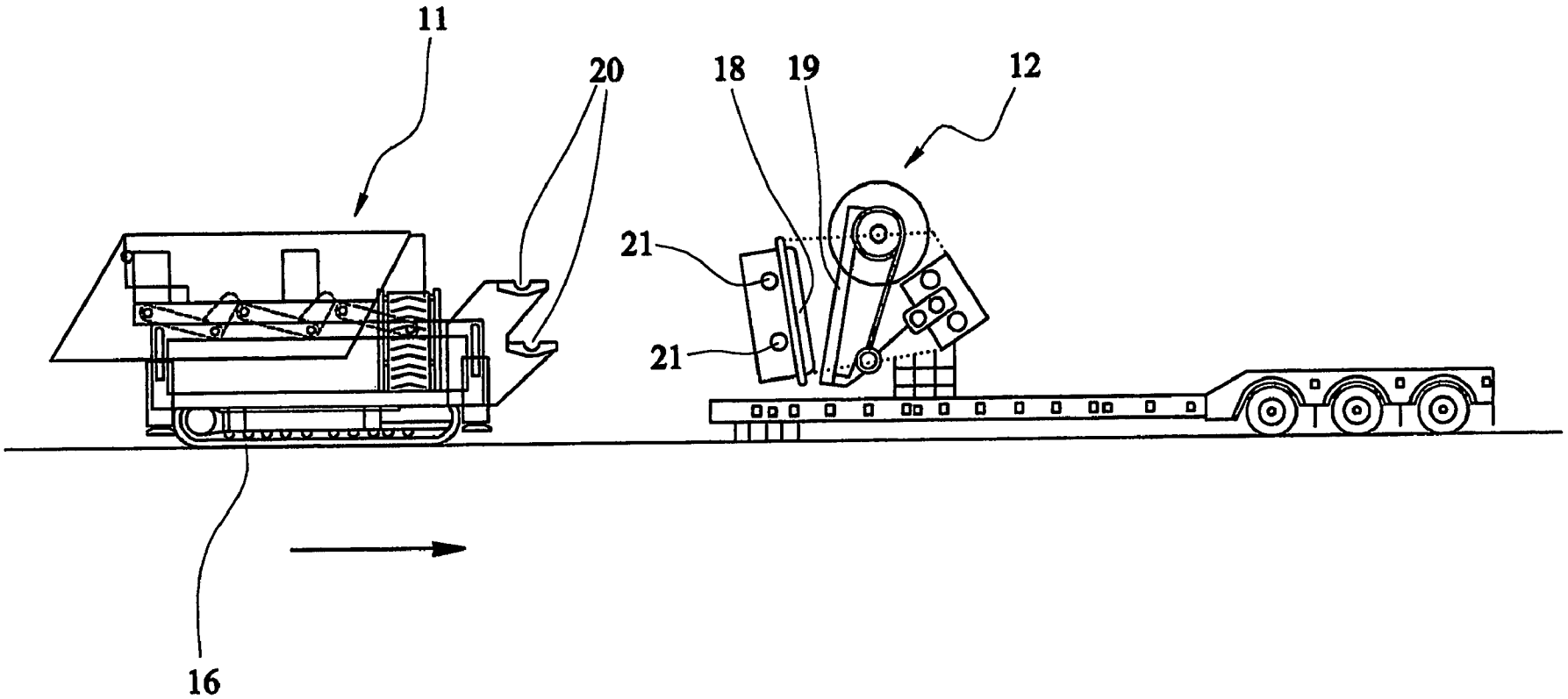
FIG. 6 is a side view showing the first feeder section moving over the ground so as to take up a position in which it can attach and lift the crusher section off the low loader and form a combined unit (rigid two part assembly) which is capable of being presented to the arrival of the third discharge section, to complete the assembly of the three component parts.
Figure 7:
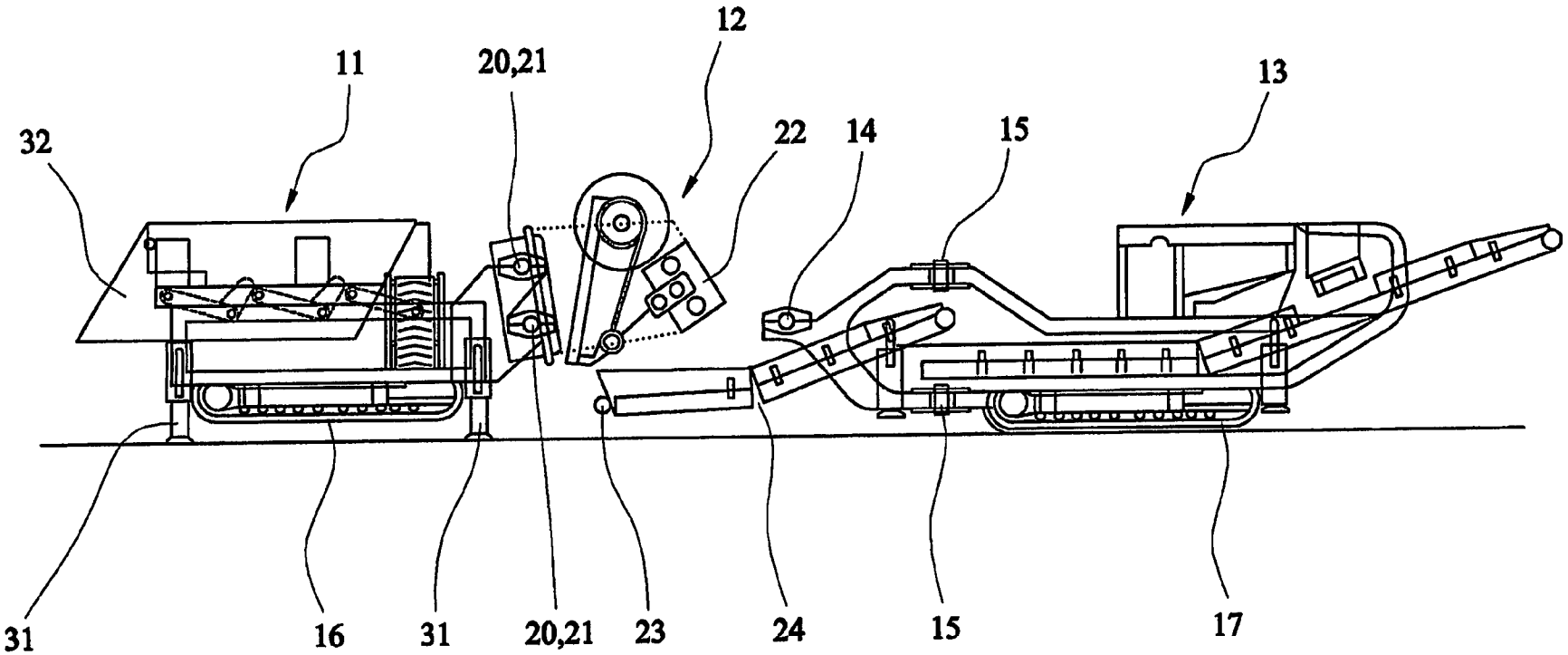
Figure 8:
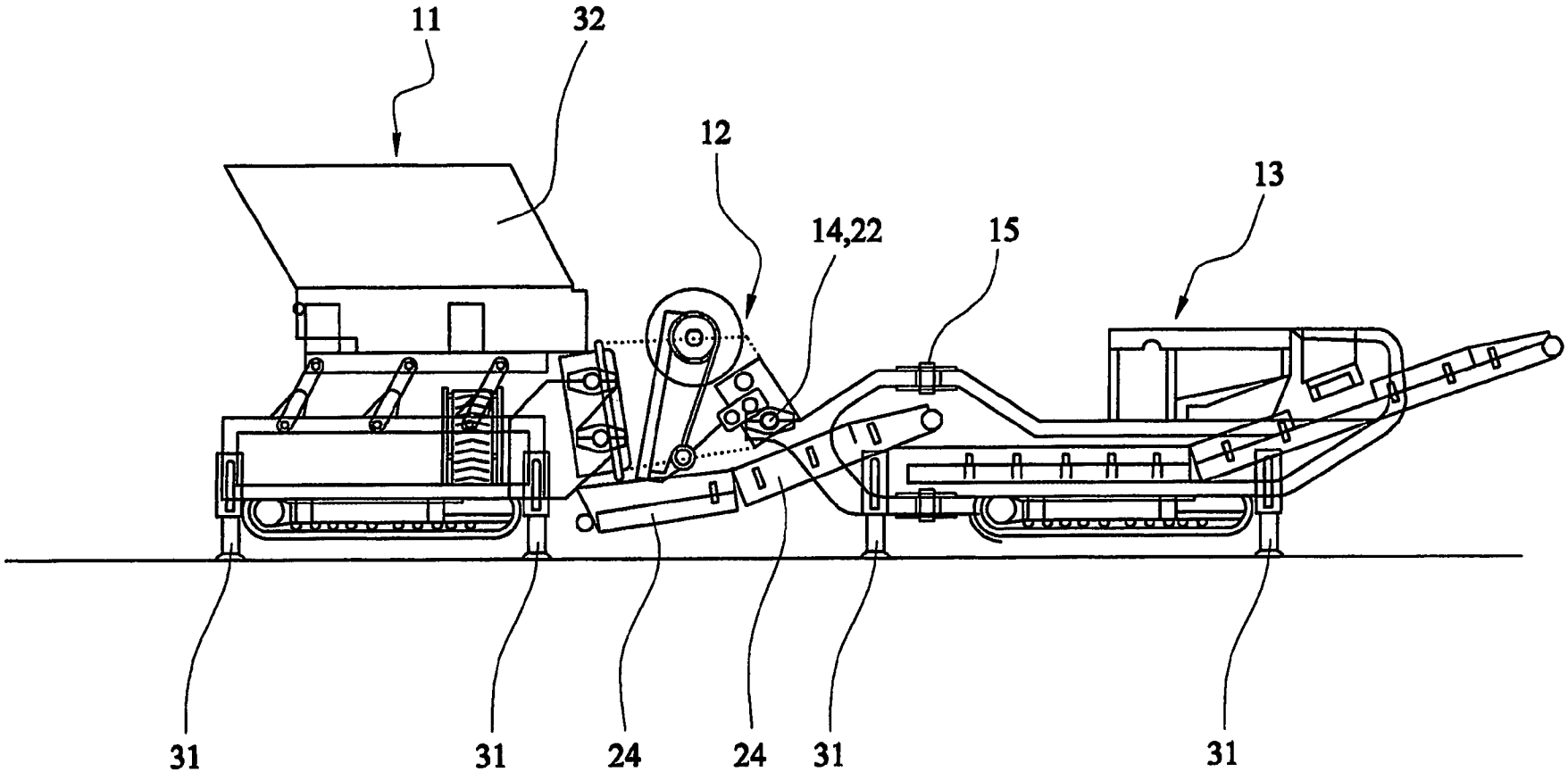

FIG. 7 is a side view showing the rigid two part assembly of the feeder section and the crusher section of FIG. 6, being presented to the discharge section for coupling together to form a 3-part crusher assembly; and FIG. 8 is a side view showing the three sections assembled together, and raised from the ground by adjustable support legs, with their propelling tracks out of contact with the ground, and able to carry out a cycle of feeding raw material to the crusher, crushing the material, discharging the crushed material to the discharge section, and then delivering the crushed material to a stockpile at a required position.

Figure 1:
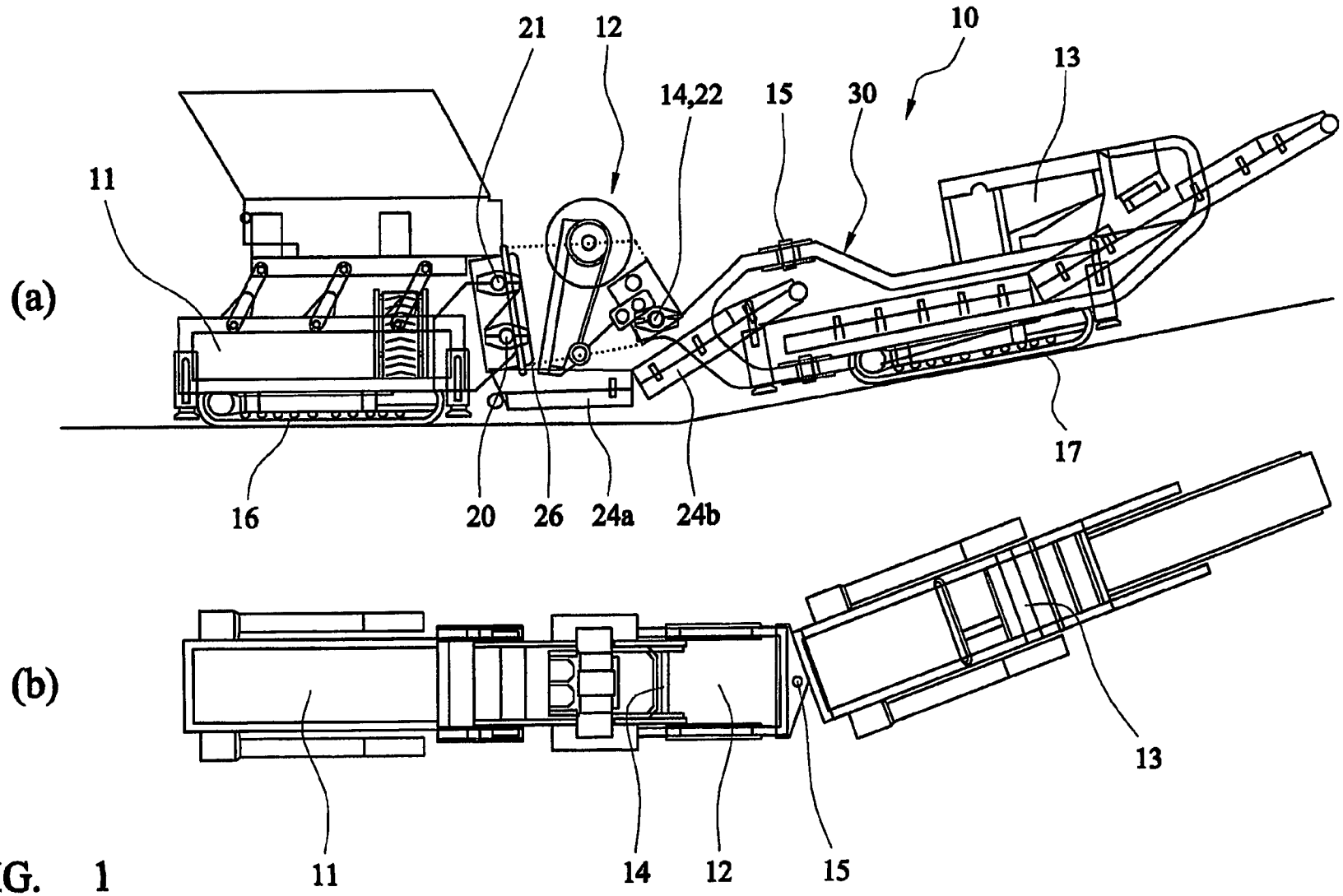
Figure 2:
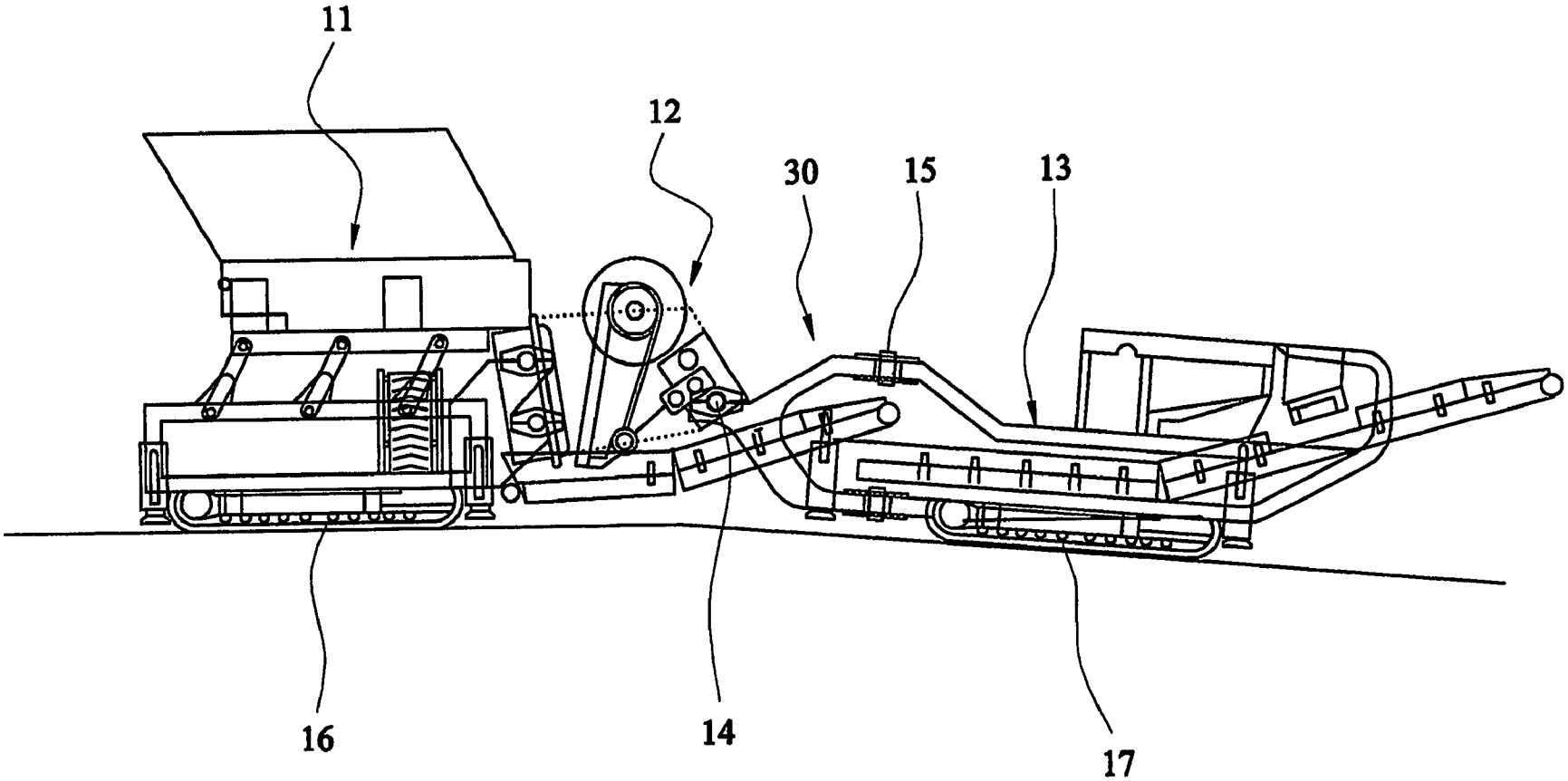
FIG. 2 is a side view, similar to FIG. 1, but showing the assembly adjusting itself to follow a different contour of ground to that shown in FIG. 1(*a*)
Figure 3:
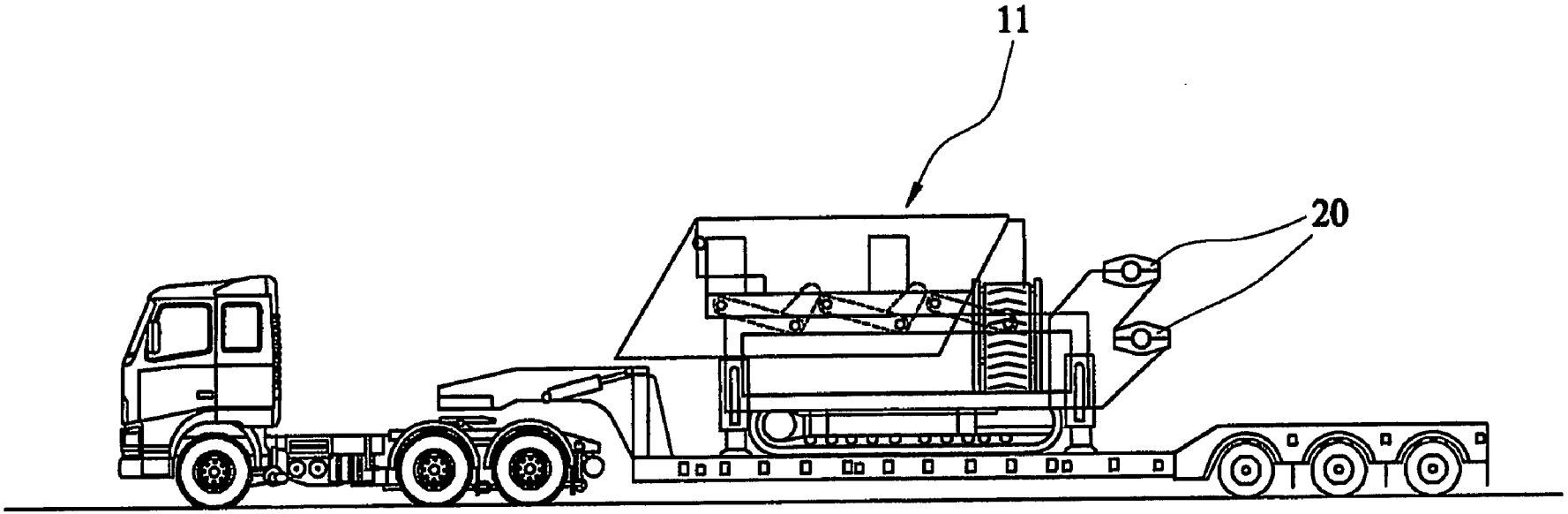
FIG. 3 is a side view of the first feeder section part, after separation from the assembly, and in a transport position on a load platform of a transport vehicle (low loader)
Figure 4:
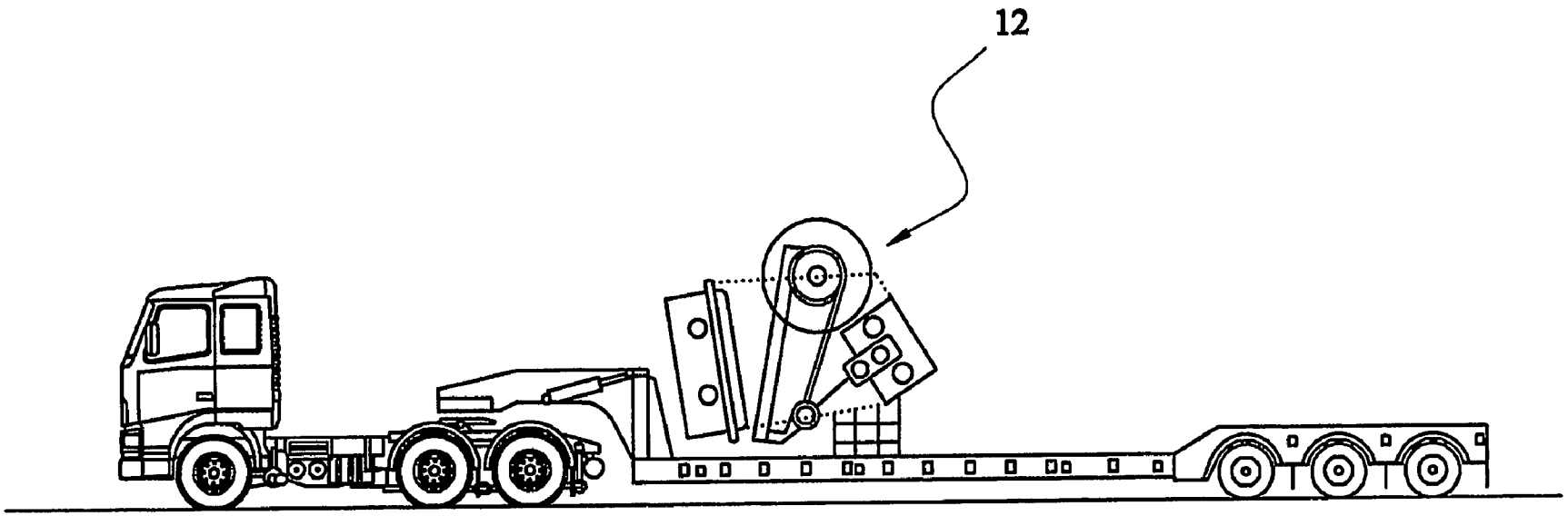
FIG. 4 is a similar view, but of the second crusher section, after separation from the assembly, and loaded on the loading platform of another transport vehicle.
Figure 5:
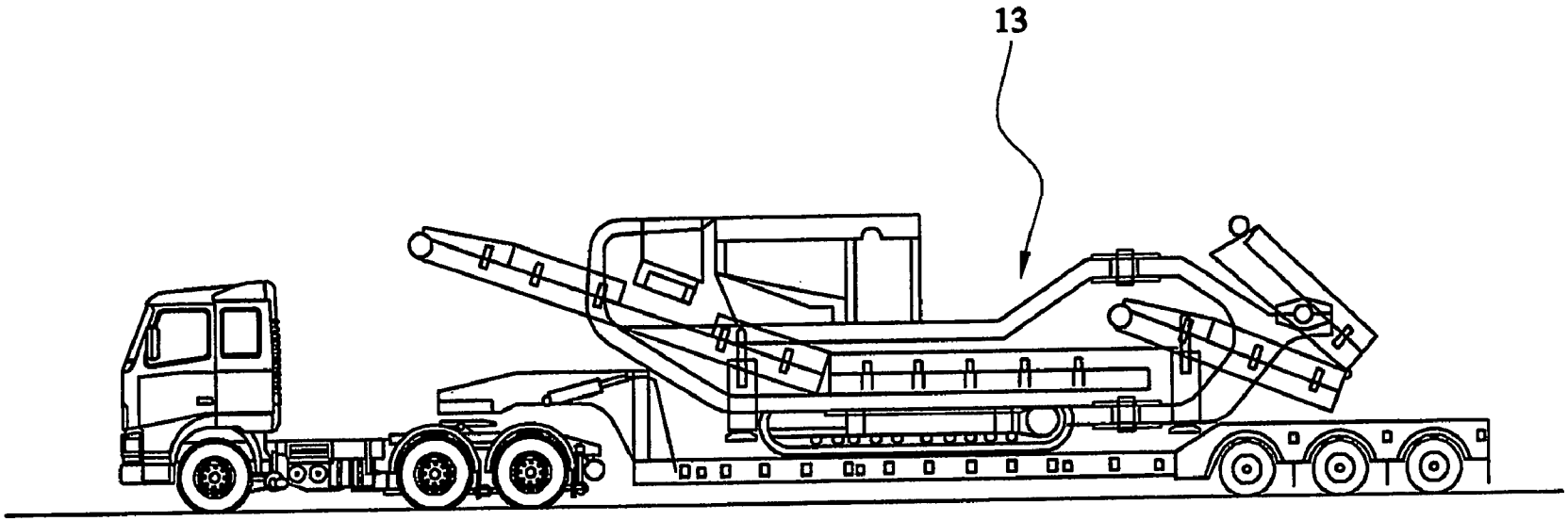
FIG. 5 is a similar view, showing the third discharge section, after separation from the assembly and loaded on the loading platform of a still further transport vehicle.

Referring first to FIGS. 1 and 2 of the drawings, a mobile 3-part crusher assembly according to the invention is designated generally by reference 10, of which a first part 11 is a feeder section for receiving a bulk supply of raw material, a second part 12 is a crusher section to receive raw material from the feeder section 11, and a third part 13 is a discharge section to receive crushed material from the crusher section 12 and to discharge the crushed material to a required stockpile.

FIG. 1(*a*) shows the 3-part assembled crusher adjusting itself to follow a transition in the ground between level ground and a slight hill, and FIG. 1(*b*) is a plan view showing how the assembly can steer itself, by relative pivoting movement between the foremost discharge section 13 and the rigid coupling-together of feeder section 11 and crusher section 12.

FIG. 2 shows how the assembly adjusts itself to follow a different ground contour.

The first, second and third parts of the crusher assembly are detachably connectable together to work in a crushing mode, as shown in FIG. 8, and to be separated from each other for individual handling and transport, in a transport mode of the assembly, as shown in FIGS. 3 to 7.

Any suitable detachable couplings are provided to enable the crusher section 11 to be coupled with and uncoupled from the feeder section 12. Similarly, detachable couplings are provided between the crusher section 12 and the discharge section 13.

In addition to the facility to uncouple the sections from each other allowing easy handling and transport of individual sections on their own transport vehicle, when assembled, the assembly provides for improved manoeuverability on site, when working in a crushing mode, or in moving from one position to another position on site preparatory to carrying out renewed crushing operations, and discharge to a new stockpile.

The crusher section 12 is pivotally connected to the discharge section 13 via two separate articulated joints 14, 15 of a forward yoke portion 30 of the frame of section 13. First joint 14 allows relative pivoting about a transverse axis extending generally parallel to the ground surface and perpendicular to the direction of travel, so as to allow the assembly to adjust itself automatically in following different ground contours, as shown in FIG. 1(*a*) and FIG. 2. Second articulated joint 15 has two vertically spaced pivots which define a generally upright pivot axis, when the assembly is standing on level, horizontal ground, to allow relative steering between the foremost section 13 and the coupled-together sections 11 and 12, as shown in FIG. 1(*b*).

Each of the feeder section 11 and the discharge section 13 can be manoeuvred independently of the other, so as to facilitate overall manoeuverability of the assembly on site. Each unit 11, 13 is therefore supported from the ground by a respective pair of endless tracks 16, 17, and preferably each chassis is provided with a separate power source.

The crusher unit 12 is a jaw-type crusher device having fixed jaw 18 and movable jaw 19, and which is detachably coupled with the feeder section 11 via a rigid coupling 20 on section 11 which allows the crusher section 12 to be mounted in cantilever manner on the feeder section, to be moveable therewith as a unit, for the purposes of:

1. loading and unloading the crusher section 12 with reference to a loading platform of a transport vehicle; and 2. coupling and uncoupling the unit (sections 11 and 12 coupled together rigidly) with the discharge section 13 via a detachable coupling between the crusher section 12 and the discharge section 13.

FIGS. 3 to 7 show how the separated sections of the 3-part crusher assembly can be transported individually, and then subsequently reassembled.

FIG. 8 shows the three component parts assembled together, and raised out of contact with the ground, so as to carry out a static crushing and discharge operation.

FIG. 6 shows how the feeder section 11 and crusher section 12 can be coupled together, with the feeder section 11 standing on the ground, and the crusher section 12 on a low loader, ready for being coupled with the feeder section 11. The feeder section 11 tracks into position to attach and lift the crusher section 12 off the low loader. When the section 12 is attached, by the mountings 21 fitting on the couplings 20 and being clamped thereto, the combination can then track itself into position and await the arrival of the discharge section 13, after it has been unloaded from its low loader shown in FIG. 5.

As shown in FIG. 7, the feeder section 11 has its feed and hopper section adjusted to a transport position, and supports the crusher section 12. The combination is then raised by lowering support legs 31, to allow the discharge section 13 to move with its forward conveyor portion 24 below the crusher section 12, and so that the coupling 14 (which defines horizontal pivot axis) of the section 13 can be coupled with horizontal mounting 22 of section 12. The forward coupling 23 of the forward conveyor portion 24 is then coupled to a suitable mounting (not shown in detail) provided on the feeder section 11 or the crusher section 12, to take-up the assembled position shown in FIG. 8.

When all three sections 11, 12, 13 have been connected together, as shown in FIG. 8, they can act as one complete unit or assembly, having one complete support chassis. The feeder section 11 can be then raised into position, and the hopper doors 32 can be raised into position to receive a supply of bulk material to be crushed. The discharge section 13 unfolds one or more stockpile conveyor, preferably a radially extending conveyor. FIG. 8 shows the complete assembly ready to carry out material-loading, crushing, screening and discharging of bulk material. When it is required to move the entire assembly to a new position on site, the support legs 31 of feeder section 11 and discharge section 13 are raised, to bring the tracks 16, 17 into contact with the ground, and the entire assembled plant can then move as a single unit around the site. The horizontal and vertical articulated joints 14, 15 allow the entire assembly to manoeuvre freely on site, despite having to undergo relative vertical movement between different sections, depending upon the ground terrain, and also to manoeuvre the three sections relatively in a lateral direction, to avoid obstacles, and to follow any particular necessary non-straight path. Also, the manoeuvrability of the complete assembly enhances the formation of progressively growing stockpiles of crushed and screened material, to take-up the space available, by relative adjustment between the sections 11 and 13.

The invention claimed is:

1. A mobile 3-part crusher assembly of which a first part is a feeder section for receiving a bulk support of material, a second part is a crusher section to receive raw material from the feeder section, and a third part is a discharge section to receive crushed material from the crusher section and to discharge the crushed material to a required stockpile;

in which the first, second and third parts of the crusher assembly are detachably connectable to work together in a crushing mode, and to be separated from each other for individual handling and transport in a transport mode of the assembly;

a first articulation connection to couple the discharge section to the remainder of the assembly, the first articulation connection configured to allow pivoting movement of the discharge section relative to the remainder of the assembly in a lateral direction to allow relative steering movement between the discharge section and the remainder of the assembly; and a second articulation connection to couple the discharge section to the remainder of the assembly, the second articulation connection configured to allow pivoting movement of the discharge section relative to the remainder of the assembly in a transverse direction to allow relative upward or downward pivoting between the discharge section and the reminder of the assembly so as to follow undulations in the surface of the ground over which the assembly travels.

2. The crusher assembly according to claim 1 in which the first articulation connection and second articulation connection provide a pivoting couple between the crusher section and the discharge section and wherein the feeder section and the discharge section are maneuverable independently of each other, so as to facilitate overall maneuverability of the assembly on site.

3. The crusher assembly according to claim 1, in which the first articulation connection and second articulation connection define pivot axes which extend approximately perpendicular to each other when the assembly is standing on level, horizontal ground.

4. The crusher assembly according to claim 1, in which each of the feeder section and the discharge section is supported by a respective pair of endless tracks.

5. The crusher assembly according to claim 4, in which the endless tracks of the feeder section and discharge section are independently operable, and each section is provided with its own power source.

6. The crusher assembly according to claim 1, in which the crusher section includes a jaw-type crusher device.

7. The crusher assembly according to claim 1, in which the crusher section is detachably coupled with the feeder section via a rigid coupling which allows the crusher section to be mounted in cantilever manner on the feeder section to be movable therewith as a unit, for the purposes of:

loading and unloading the crusher section with reverence to a loading platform of the transport vehicle; and, coupling and uncoupling the assembled unit of feeder section and crusher section relative to the discharge section via a detachable coupling between the crusher section and the discharge section.

8. The crusher according to claim 1, in which the crusher section, or the discharge section, includes one or more screening portion to separate crushed material into different size ranges.

* * * * *